US012305505B1

(12) United States Patent
Seren

(10) Patent No.: US 12,305,505 B1
(45) Date of Patent: May 20, 2025

(54) UNDERWATER TOOLS WITH SACRIFICIAL BATTERY

(71) Applicant: ARAMCO SERVICES COMPANY, Houston, TX (US)

(72) Inventor: Huseyin Rahmi Seren, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/427,547

(22) Filed: Jan. 30, 2024

(51) Int. Cl.
*E21B 47/12* (2012.01)
*E21B 41/00* (2006.01)
*E21B 47/00* (2012.01)

(52) U.S. Cl.
CPC ..... *E21B 47/138* (2020.05); *E21B 41/0085* (2013.01); *E21B 47/00* (2013.01); *E21B 2200/08* (2020.05)

(58) Field of Classification Search
CPC ..... E21B 29/02; E21B 41/0085; E21B 47/00; E21B 47/135; E21B 2200/08
See application file for complete search history.

(56) References Cited

U.S. PATENT DOCUMENTS

| | | | |
|---|---|---|---|
| 2,092,316 | A | 9/1937 | Lane |
| 3,487,484 | A | 1/1970 | Holmes |
| 4,258,568 | A | 3/1981 | Boetes et al. |
| 4,408,488 | A | 10/1983 | Marshall |
| 4,777,819 | A | 10/1988 | Hoyt et al. |
| 4,855,820 | A | 8/1989 | Barbour |
| 5,515,924 | A | 5/1996 | Osterhoudt, III |
| 5,816,874 | A | 10/1998 | Juran et al. |
| 5,944,195 | A | 8/1999 | Huang et al. |
| 6,241,028 | B1 | 6/2001 | Bijleveld et al. |
| 6,446,718 | B1 | 9/2002 | Barrett et al. |
| 6,976,535 | B2 | 12/2005 | Aronstam et al. |
| 7,495,350 | B2 | 2/2009 | Pinkerton et al. |
| 7,819,189 | B1 | 10/2010 | Cosby |
| 8,584,519 | B2 | 11/2013 | Maida et al. |
| 10,900,351 | B2 | 1/2021 | Deffenbaugh et al. |
| 11,879,328 | B2 | 1/2024 | Seren et al. |
| 2002/0185273 | A1 | 12/2002 | Aronstam et al. |

(Continued)

FOREIGN PATENT DOCUMENTS

| | | | |
|---|---|---|---|
| CN | 2725529 | Y | 9/2005 |
| CN | 102268986 | A | 12/2011 |

(Continued)

OTHER PUBLICATIONS

H. R. Seren, et al., "Electro-permanent magnetic weight release mechanism for buoyancy control of an autonomous well-logging tool", 2021, AIP Advances, vol. 11, 025117 (8 pages).

(Continued)

*Primary Examiner* — Brad Harcourt
(74) *Attorney, Agent, or Firm* — Osha Bergman Watanabe & Burton LLP

(57) ABSTRACT

An untethered device includes a tool including circuitry, a ballast weight mechanically attached to the tool, and including a dissolvable ballast, and a sacrificial battery including a first electrode provided by the dissolvable ballast and an electrolytic solution provided by a fluid surrounding the untethered device. The sacrificial battery powers the circuitry.

20 Claims, 6 Drawing Sheets

(56) References Cited

U.S. PATENT DOCUMENTS

| | | | | |
|---|---|---|---|---|
| 2005/0241824 | A1 | 11/2005 | Burris et al. | |
| 2005/0241825 | A1 | 11/2005 | Burris et al. | |
| 2006/0157239 | A1 | 7/2006 | Ramos et al. | |
| 2009/0126938 | A1 | 5/2009 | White | |
| 2010/0268470 | A1 | 10/2010 | Kamal et al. | |
| 2011/0253373 | A1 | 10/2011 | Kumar et al. | |
| 2012/0085538 | A1 | 4/2012 | Guerrero et al. | |
| 2013/0192823 | A1 | 8/2013 | Barrilleaux et al. | |
| 2013/0333872 | A1 | 12/2013 | McMillon et al. | |
| 2014/0076542 | A1 | 3/2014 | Whitsitt et al. | |
| 2014/0131045 | A1* | 5/2014 | Loiseau | E21B 43/119 166/241.1 |
| 2014/0345878 | A1* | 11/2014 | Murphree | E21B 34/14 166/377 |
| 2015/0107855 | A1 | 4/2015 | Murphree et al. | |
| 2022/0205343 | A1* | 6/2022 | Fripp | E21B 43/27 |

FOREIGN PATENT DOCUMENTS

| | | | |
|---|---|---|---|
| EP | 1181435 | B1 | 11/2004 |
| JP | 2000065659 | A | 3/2000 |
| JP | 2002233270 | A | 8/2002 |
| JP | 2004290096 | A | 10/2004 |
| JP | 2008237167 | A | 10/2008 |
| WO | 0073625 | A1 | 12/2000 |
| WO | 2011097063 | A2 | 8/2011 |
| WO | 2011146866 | A2 | 11/2011 |
| WO | 2016/176643 | A1 | 11/2016 |

OTHER PUBLICATIONS

E. Buzi, et al. "Sensor Ball: An Autonomous Untethered Logging Platform", Offshore Technology Conference, Houston, Texas, USA, May 2020 (10 pages).

Z. Xu, et al., "The Art of Disintegration—Ten Years in Review of Disintegrable Metals and Downhole Tools", Offshore Technology Conference-29624-MS, Apr. 2019, pp. 1-14 (14 pages).

R. Mori, "Recent developments for aluminum-air batteries", Electrochemical Energy Reviews, 2020, vol. 3, No. 2, pp. 344-369 (26 pages).

P. Nadeau et al., "Prolonged energy harvesting for ingestible devices", Nature biomedical engineering, 2017, vol. 1, No. 3, pp. 1-8 (8 pages).

"TI-BQ25504 Ultra Low-Power Boost Converter With Battery Management For Energy Harvester Applications", Texas Instruments, Oct. 2011, Revised Aug. 2023 (39 pages).

Office Action in corresponding Japanese Patent Application No. 2017-556568 mailed Dec. 18, 2018 (7 pages).

International Search Report and Written Opinion issued in corresponding International Application No. PCT/US2016/030260, mailed Aug. 17, 2016 (10 pages).

Office Action in corresponding Chinese Patent Application No. 201680024913.4, mailed Sep. 1, 2020 (17 pages).

Notice of Allowance in corresponding Korean Patent Application No. 10-2019-7010194, mailed Apr. 21, 2020 (4 pages).

Examination Report in corresponding Korean Patent Application No. 10-2019-7010194, mailed Oct. 29, 2019 (6 pages).

N. Ukrainczyk et al., "Thermophysical Comparison of Five Commercial Parafffin Waxes as Latent Hear Storage Materials", Chemical and Biochemical Engineering Quarterly, 2010, vol. 24, No. 2, pp. 129-137 (10 pages).

Communication pursuant to Article 94(3) EPC in European Application No. 16721049.1-1005, issued Feburary 15, 2022 (8 pages).

Communication pursuant to Article 94(3) EPC in European Application No. 16721049.1-1005, issued Aug. 21, 2020 (5 pages).

Communication pursuant to Article 94(3) EPC in European Application No. 16721049.1-1005, issued Apr. 7, 2020 (7 pages).

Office Action in corresponding Chinese Patent Application No. 201680024913.4, mailed Apr. 28, 2021 (15 pages).

Examination Report issue din GC Application No. GC 2016-37391 dated Oct. 7, 2019 (4 pages).

* cited by examiner

UNDERWATER TOOLS WITH SACRIFICIAL BATTERY

BACKGROUND

Energy budgets may be of critical importance for tools that operate off-the-grid, such as robots operating in remote locations. These tools may use energy for locomotion, operating sensors and actuators, performing computations, and/or communication. The necessary electrical energy may be stored in local batteries or may be harvested from the environment. Batteries may occupy a large portion of the body weight and/or volume of a tool. Increasing the energy density of batteries and/or harvesting additional usable energy may, thus, be explored to extend mission duration, capabilities, and/or to miniaturize the tool.

Tools may include robots that operate under water (locations including oceans, lakes, rivers, and downhole). Underwater robots often rely on effective density change for traveling to a desired depth where effective density is defined as $d_{eff}=M_{total}/V_{total}$, where $M_{total}$ and $V_{total}$ are total mass and volume of the robot, respectively. While some robots can continuously tune their effective density by filling and emptying a bladder, some other robots rely on a ballast to sink. The ballast may be released for the robot to rise. When a ballast is attached to and removed from the body of the robot, the effective density of the robot may become larger or smaller than the fluid (e.g., water or oil). The releasable ballast acts as a storage of potential energy. The potential energy is stored in the ballast based on its mass and distance from the bottom (bottomhole, ocean floor, etc.). This energy is partially transferred to kinetic energy as the robot sinks. Another portion is transferred to potential energy of the buoyant robot body, and once the ballast is released, this potential energy is converted to kinetic energy to lift the robot to the surface. A portion of the potential energy may be lost to heat via dissipative forces such as the drag force.

One example of such a robot is an untethered device that may be used in oil and gas applications for untethered logging, intervention, stimulation. Such devices are unattached to a wellbore surface and are deposited in a wellbore to descend in a downhole direction. The untethered device may include a dissolvable (or disintegrating) ballast. The ballast may further be released on-demand with the help of an electromagnetic actuator.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to an untethered device comprising: a tool comprising circuitry; a ballast weight mechanically attached to the tool, and comprising a dissolvable ballast; and a sacrificial battery comprising a first electrode provided by the dissolvable ballast and an electrolytic solution provided by a fluid surrounding the untethered device, wherein the sacrificial battery powers the circuitry.

In general, in one aspect, embodiments relate to a method for recovering an untethered device, the method comprising: receiving, inside a tool of the untethered device, fluid leaking into the tool; exposing an electrode inside the tool to the fluid to form a sacrificial battery comprising the electrode inside the tool, an electrode on a ballast weight of the untethered device, and the fluid; powering a ballast release circuit by the sacrificial battery; and activating, by the ballast release circuit, a ballast release actuator to release the ballast weight.

In light of the structure and functions described above, embodiments of the disclosure may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
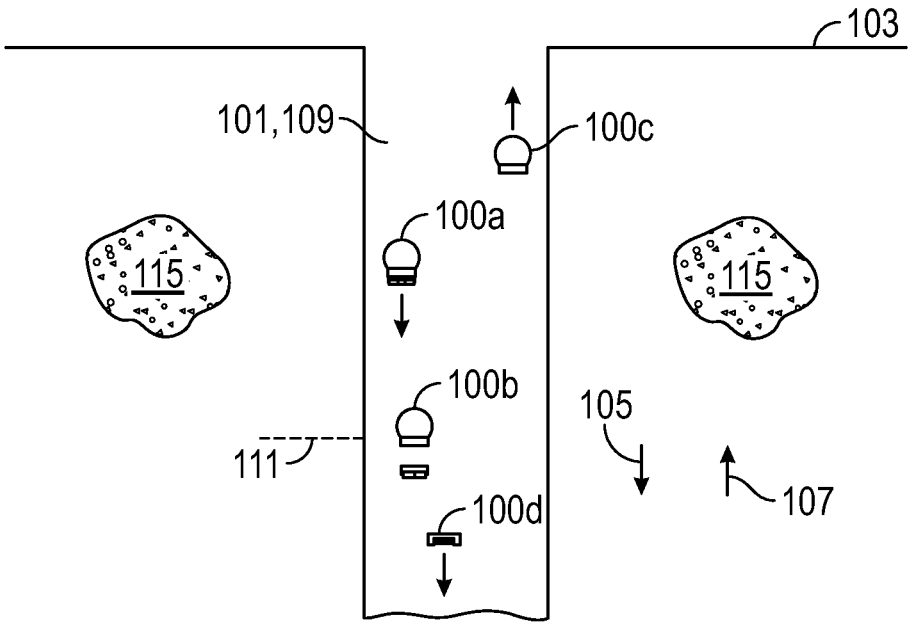
FIG. 1 shows several states of example untethered devices, in accordance with embodiments of the disclosure.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for off-the-grid operation of tools. Examples of such tools include, but are not limited to, robots that operate in remote locations. An example is a device that may be used for an untethered logging, intervention, stimulation, and/or other operations. The device may be, for example, an untethered device that is unattached to a wellbore surface and is deposited in a wellbore to descend in a downhole direction.

The untethered device may include electrically powered components for locomotion, sensing, performing computations, communicating, etc. In some embodiments, at least some of the electrical energy needed to perform these functions may be contributed by a sacrificial battery of the untethered device. The sacrificial battery may be in addition to other energy sources, or it may be the sole supply of electrical energy.

The untethered device may rely on a ballast to sink in the downhole environment. The ballast may be released and/or may dissolve to change the buoyancy of the untethered device, enabling a tool of the untethered device to rise to the surface, in absence of the ballast.

The ballast may be dissolvable (or disintegrating, or degrading) to prevent cluttering inside the well as released ballasts can aggregate over time, and to provide a fail-safe mechanism in case the weight release function fails due to any reason.

Furthermore, in some embodiments, the ballast forms an electrode of a sacrificial battery for the untethered device. In some embodiments, aluminum alloys and/or magnesium alloys are used as dissolvable materials for the ballast. An aluminum or magnesium-based first electrode of the sacrificial battery may thus be formed by the ballast. A second electrode of the sacrificial battery may be formed using another metal.

Electrical energy may thus be harvested from the potential chemical energy stored in the metal of the ballast. The electrical energy may serve as a sole or auxiliary energy source of the untethered device.

The ballast may, thus, serve dual purposes, as further described below with reference to the figures.

Embodiments of the disclosure have various benefits. Energy budgets may be important for devices that operate off-the-grid, such as robots operating in remote locations. Batteries may occupy a large portion of the body weight and/or volume of the device, and increasing the energy density of batteries and/or harvesting additional usable energy may, thus, be explored to extend mission duration, capabilities, and/or to miniaturize the tool. The addition of a sacrificial battery through use of the ballast as an electrode in accordance with some embodiments provides an additional energy source and increases the usable energy density.

FIG. 1 shows several states of example untethered devices (100) (e.g., 100*a*, 100*b*, 100*c*, 100*d*) for measuring properties (e.g., collecting data) along a wellbore (101) to log the wellbore (101). Such properties may be related to one or both of wellbore fluid (109) within the wellbore (101) or a rock formation (115) in which the wellbore (101) is formed. The untethered devices (100) are unattached (e.g., either directly or indirectly) to a surface (103) from which the wellbore (101) extends. The untethered devices (100) are deployable to the wellbore (101) to move (e.g., sink) in a downhole direction (105) through the wellbore fluid (109) while logging the wellbore (101) (e.g., refer to 100*a*), to sufficiently increase their buoyancy when the untethered logging devices (100) reach a target depth (111) along the wellbore (101) (e.g., refer to 100*b*), and to consequently move (e.g., rise) in an uphole direction (107) through the wellbore fluid (109) towards the surface (103) while logging the wellbore (101) (e.g., refer to 100*c*), whereas the ballast may sink (e.g., refer to 100*d*).

Figure 2:
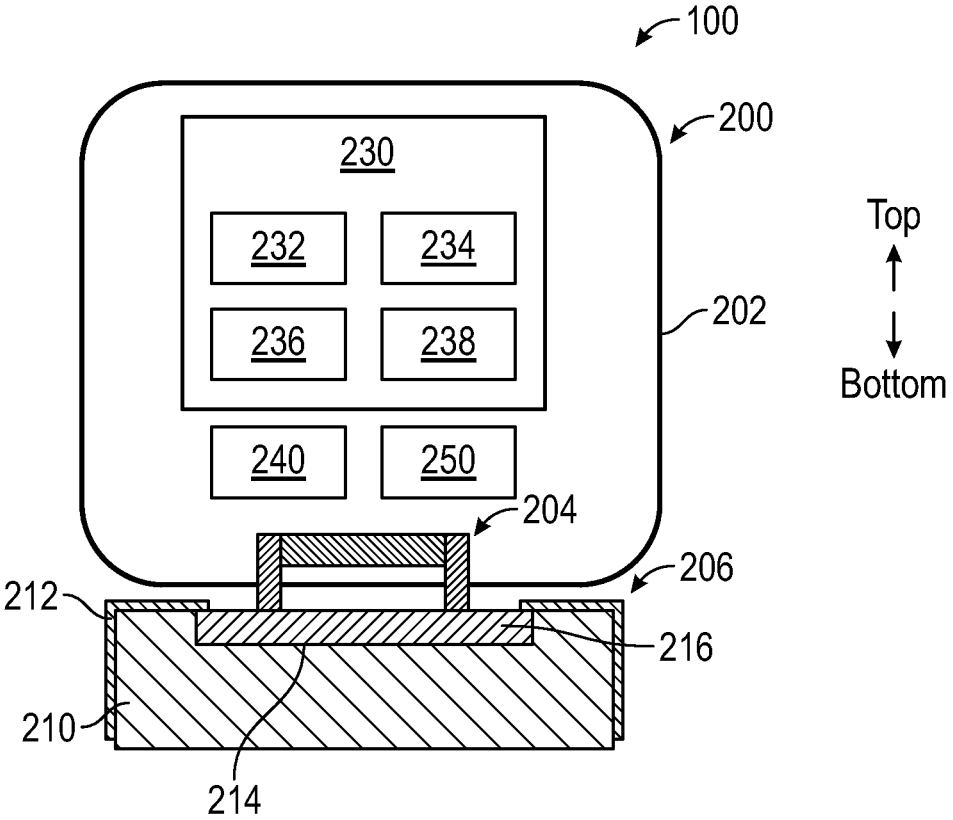
FIG. 2 shows a cross-sectional view of an example untethered device, in accordance with embodiments of the disclosure.

FIG. 2 shows a cross-sectional view of an example untethered device (100), in accordance with embodiments of the disclosure.

In one or more embodiments, the tool (200) includes circuitry (230) that controls various functionalities of the untethered device (100). In some embodiments, the circuitry (230) includes a receiver (232), a transmitter (234), a controller (236), and one or more processors (238). The tool (200) may also include an internal battery (240) that powers various components of the untethered device (100).

In one or more embodiments, the tool (200) includes one or more sensors (250) that may be powered by the internal battery (240). The sensor(s) (250) may measure one or more physical, chemical, geological, or structural properties along the wellbore (101) to log the wellbore (101). The measurements may be continuously performed. Example properties include elapsed time, temperature, pressure, fluid density, fluid viscosity, fluid flow rate, magnetic field, gamma ray intensity, tool acceleration, tool rotation, and other parameters. The continuous measurements may be acquired while the tool (200) both descends and ascends through the wellbore fluid (109). During the logging operation, the transmitter (224) may send data carrying the real-time measurements to one or more devices located at the surface (103) for further processing of the data. Alternatively, the data may be stored for later retrieval.

As previously noted, the untethered device (100) is configured to change its buoyancy in order to move in an uphole direction (107), e.g., after reaching a target depth (111). The change in buoyancy is achieved by releasing the ballast weight (206).

Releasing of the ballast weight (206) may be achieved in multiple different manners as subsequently described following a discussion of the components of the ballast weight (206).

In one or more embodiments, the ballast weight (206) includes a dissolvable ballast (210) and an attachment plate (216) disposed on the dissolvable ballast.

The attachment plate (216) may be a metal plate that is made of one or more ferromagnetic materials, such as high-permeability, soft ferromagnetic materials (e.g., carbon steels or nickel-iron alloys). The resulting attractive force between the attachment plate (216) and the switchable magnet (204) ensures that the attachment plate (216) remains secured to the switchable magnet (204) until the switchable magnet (204) is operated to release the entire ballast weight (206) as a unit from the switchable magnet (204) of the untethered device (100).

The dissolvable ballast (210) may be made of one or more non-magnetic materials, such as aluminum, magnesium, and a metalpolymer composite material. The dissolvable ballast (210) may have a weight between 50 g and 200 g, or any other weight, without departing from the disclosure. The size of the dissolvable ballast (210) may be determined by the wellbore geometry and the design of the other elements of the untethered device. The diameter and height of a dissolvable ballast (210) with a cylindrical shape may be between 0.5 and 2 inches, although other regular and irregular shapes may be used without departing from the disclosure. The dissolvable ballast (210) may be coated with a coating (212) that initially partially covers an exposed exterior surface of the dissolvable ballast (210) to slow down or otherwise delay the degrading process of the dissolvable ballast (210), thereby suppressing the exothermic heat generation and byproduct formation associated with the dissolution of the dissolvable ballast (210) for several hours to days depending on the thickness of the coating (212). This delay provides a window for the untethered device (100) to operate without excessive heat and byproduct formation. The presence of the coating (212) may further ensure that the untethered device (100) sinks to the target depth (111) before the dissolvable ballast (210) can sufficiently degrade to critically reduce the overall density of the untethered device (100).

The coating (212) may be made of one or more materials, such as a polymer (e.g., epoxy or xylan) or an oxide (e.g., alumina or silica). The thickness of the coating (212) may be between 10 μm and 1 mm. The coating (212) may have any other thickness, without departing from the disclosure. Thicker coating delays the dissolution further. The coating (212) may be applied to the dissolvable ballast (210) by utilizing techniques such as dip coating, spray coating, anodization, electrodeposition, vapor deposition, etc.

Continuing with the discussion of the releasing of the ballast weight (206), the ballast weight (206) may be released by switching the switchable magnet (204) from a state in which the ballast weight (206) is magnetically held at the attachment plate (216) of the ballast weight (206) to a state in which the attachment plate (216) is no longer held by the switchable magnet (204), thereby releasing the ballast weight (206). Ballast release mechanisms are described below in reference to FIGS. 4A and 4B.

The decoupling (e.g., referring to 100*b* in FIG. 1) of the attachment plate (216) from the switchable magnet (204) may occur at the target depth (111) (e.g., a preprogrammed depth that is detected based on a sensor measurement). Upon release of the ballast weight (206) from the switchable magnet (204), an overall (e.g., bulk) density of the untethered device (100) decreases (e.g., instantaneously) to a value that is less than that of the wellbore fluid (109). Accordingly, the untethered device (100) (e.g., the functional module remaining after release of the ballast weight (206)) is buoyant enough to float in the uphole direction (207) (e.g., referring to 100*c* in FIG. 1) to be retrieved at the surface (103). In this way, connection or disconnection of the ballast weight (206) governs whether the untethered device (100) descends (e.g., sinks) in the downhole direction (105) or ascends (e.g., floats upward) in the uphole direction (107) through the wellbore fluid (109).

While the tool (200) of untethered device (100) floats upward, the ballast weight (206) continues to descend, frequently as a unit, toward the bottomhole end (113) of the wellbore (101) (e.g., referring to 100*d* in FIG. 1). While the ballast weight (206) remains in the wellbore (101), the dissolvable ballast (210) gradually degrades over an extended period of time (e.g., several hours to several days).

The release of the ballast weight (206) by operating the switchable magnet (204) may be considered a primary release mechanism. A secondary release mechanism, different from the primary release mechanism, is subsequently described. The secondary release mechanism may be relied upon if the primary release mechanism fails or is not used for other reasons.

The secondary release mechanism, in one or more embodiments, is enabled by dissolution of the dissolvable ballast (210) or one or more attachment elements such as screws, bolts, or nuts (not shown) that mechanically connect the dissolvable ballast (210) and the attachment plate (216). Even when the switchable magnet (204) remains activated, the dissolvable ballast (210) may be released, while the attachment plate (216) may remain attached to the switchable magnet (204).

The dissolving rate of the dissolvable ballast (210) may depend on the material(s) of the dissolvable ballast. For example, by adding impurity elements such as Ga, In, Sn, Bi, Mg, or Zn to aluminum alloys, the rate of dissolution (or corrosion) can be accelerated. During the dissolving process, aluminum or magnesium reacts with water and becomes oxidized as shown in the equations below:

$$2Al+6H_2O \rightarrow 2Al(OH)_3+3H_2$$

$$Mg+2H_2O \rightarrow Mg(OH)_2+H_2.$$

In some embodiments, the dissolvable ballast (210) serves as an electrode of a sacrificial battery. Depending on the size of the untethered device (100), the dissolvable ballast (210) may possess a significant mass, suitable for a sacrificial battery with a significant capacity. Assuming, for example, a 50 g aluminum-based dissolvable ballast, and with aluminum batteries having a theoretical energy density of 8.1 kWh/kg, and further assuming utilization of the aluminum with 1% efficiency, the sacrificial battery may supply 4 Wh of energy.

Different metals have different electrode potentials. For example, aluminum has an electrode potential of −1.66 V. When paired with a copper electrode which has an electrode potential of +0.34 V, the aluminum electrode may serve as an anode and the copper electrode may serve as a cathode. In the example of the untethered device (100), the copper electrode may be provided by the housing (202). In other words, at least part of the housing (202) may include a copper surface. The pair may generate an electric potential of up to 2 V when placed in a conductive fluid such as salty water or brine. Oceans and downhole water reservoirs may have varying salt concentrations. The salts are predominantly sodium chloride (NaCl) and potassium chloride (KCl) which can provide the necessary conductive electrolytic solutions for the sacrificial battery. Accordingly, in the untethered device (100), a sacrificial battery may be formed between the ballast weight (206) serving as an anode, and the housing (202) serving as a cathode, with the surrounding fluid providing the electrolytic solution. Additional details are provided in reference to FIG. 3.

In order to enable harvesting of the electrical energy, a conductive path to the dissolvable ballast (210) is required. In the example as shown, a conductive adhesive (214) increases conductivity between the dissolvable ballast (210) and the attachment plate (216). An insulated wire may releasably provide an electrical interface between the attachment plate (216) and the inside of the tool (200) where the electrode potential may be received. Alternatively, elements of the switchable magnet (204) may serve as conductors to the inside of the tool.

Figure 3:
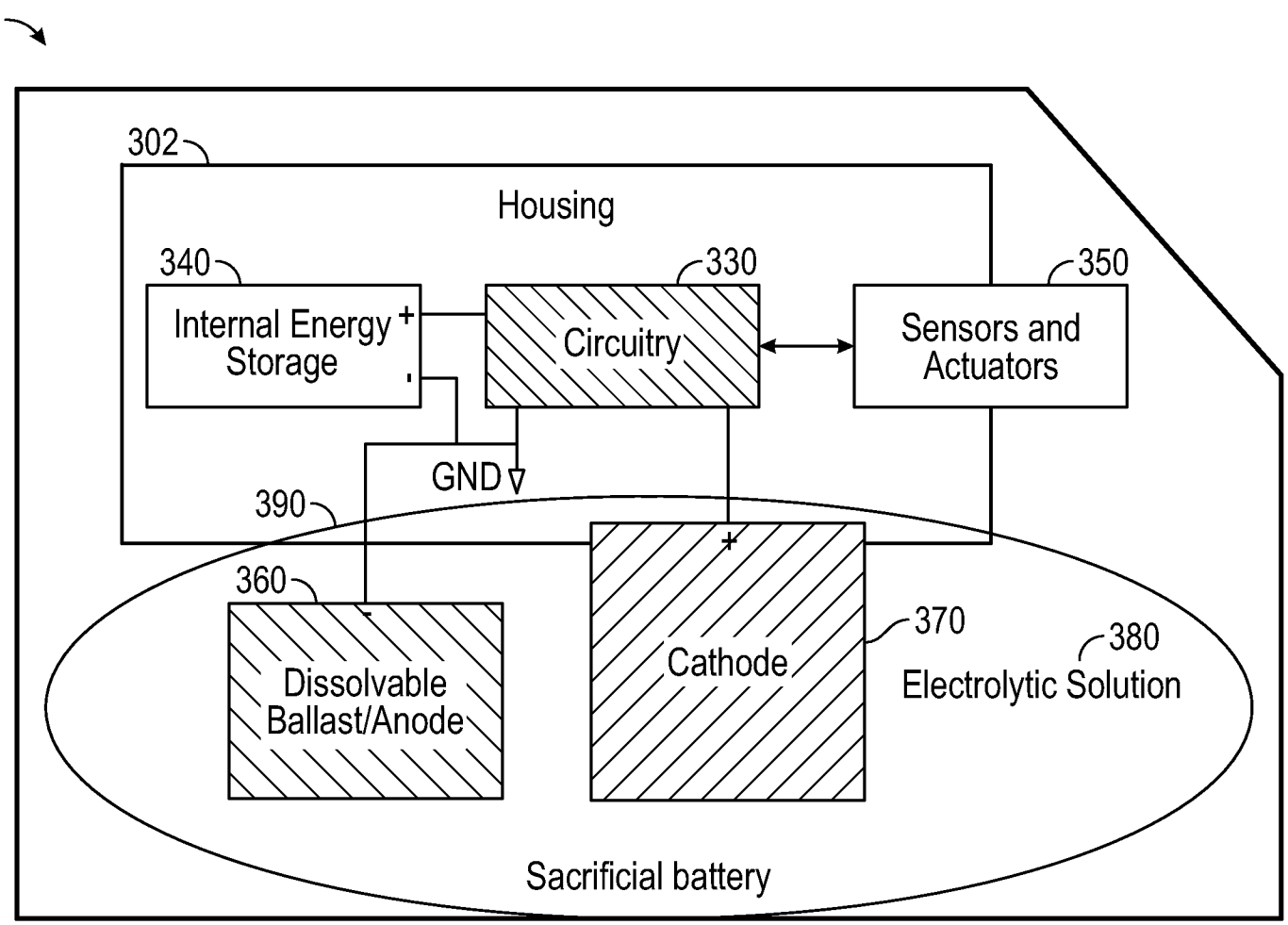
FIG. 3 schematically shows elements of an untethered device, in accordance with embodiments of the disclosure.

FIG. 3 schematically shows elements of an untethered device (300), in accordance with embodiments of the disclosure. In the example, the untethered device (300) is surrounded by a fluid, e.g., water or brine (380). The untethered device (300) includes a housing (302) that is sealed and that may protect internal components from the water (380). The housing (302) may be kept at atmospheric pressure, or it may be filled with a fluid (e.g., oil) to withstand the external pressure at depths. A first electrode, e.g., an anode (360) may be provided by the dissolvable ballast (shown, for example, in FIG. 2). The anode (360) may be electrically connected to the circuitry (330) using an insulated wire or any alternative electrical contact. The second electrode, e.g., a cathode (370) may extend through the housing (302), or it may be entirely external to the housing, with a wire connecting the cathode (370) to the circuitry. The combination of the first electrode (360), the second electrode (370), and the electrolytic solution (380), in some embodiments, form the sacrificial battery (390). The sensors and actuators (350) may or may not be exposed to the environment external to the housing (302), depending on their function. Further, the internal energy storage (340) and the circuitry (330) may be entirely inside the housing (302) to prevent exposure to the electrolytic solution (380). In some embodiments, the circuitry (330) is powered by the internal energy storage (340). The internal energy storage (340) may be a primary battery, a rechargeable battery, a capacitor, or a super-capacitor.

Energy harvested from the sacrificial battery (390) may be used to charge the internal energy storage (340). If the internal energy storage (340) is non-rechargeable (e.g., a primary battery), the harvested energy may be used to charge a separate capacitor or super-capacitor configured to power one or more functions. These functions may include, for example, powering a microcontroller of the circuitry (330), powering one or more sensors and/or actuators (350), and/or powering the release of the dissolvable ballast.

If necessary, the voltage provided by the sacrificial battery (390) may be increased to a standard voltage (e.g., 3.3V, 5V etc.), using a step-up converter circuit.

Figure 4A:
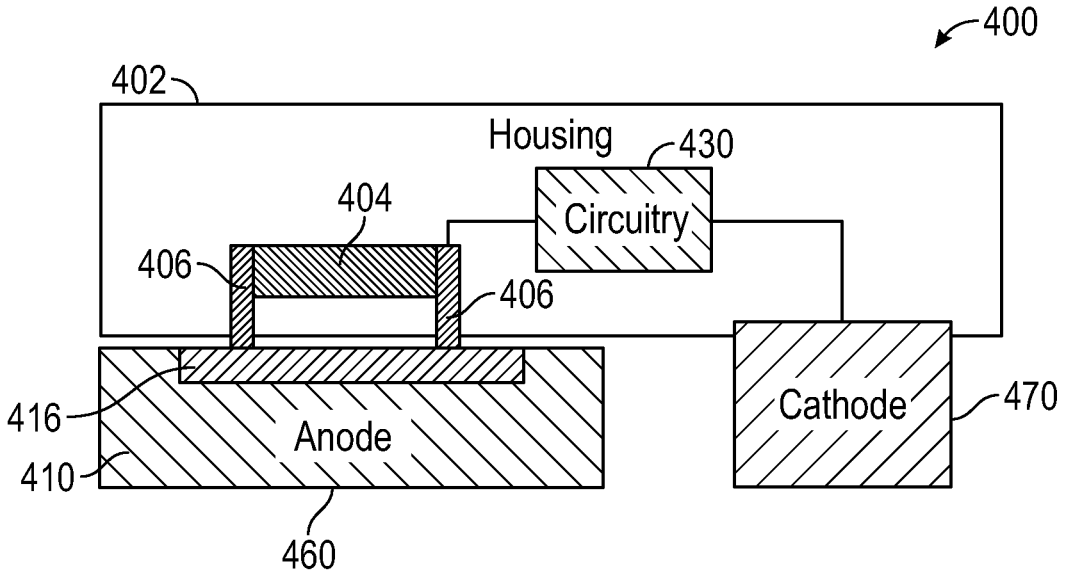
FIGS. 4A and 4B schematically show ballast release mechanisms, in accordance with embodiments of the disclosure.
Figure 4B:
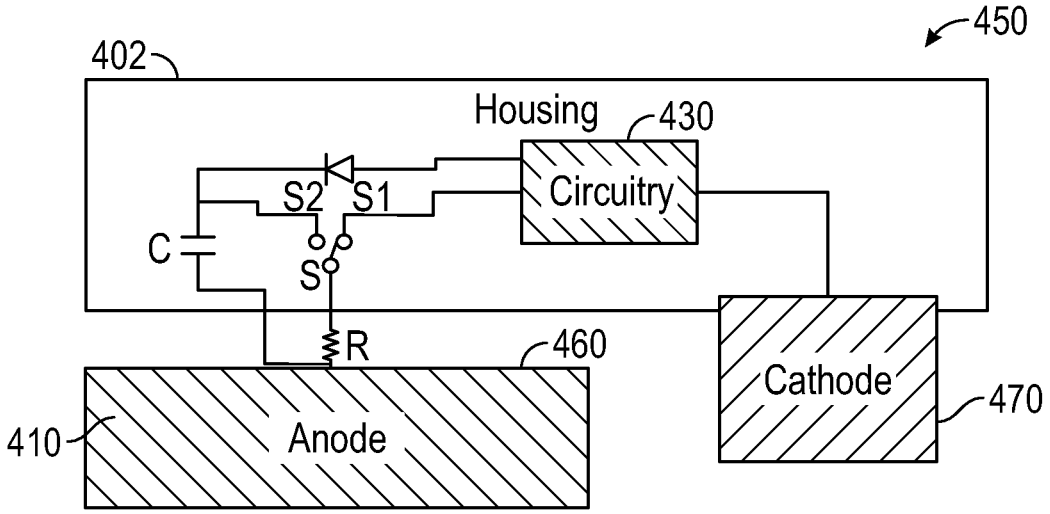

FIGS. 4A and 4B schematically show ballast release mechanisms (400), in accordance with embodiments of the disclosure. Referring to FIG. 4A, the ballast release mechanism is based on a switchable magnet (404). The switchable magnet (404), in a default configuration holds the attachment plate (416) at pole pieces (406) of the switchable magnet (404)

In one or more embodiments, the ballast release mechanism includes a switchable magnet (404) which includes permanent magnets and an electromagnetic actuator. For example, the switchable magnet (404) may include two permanent magnets connected in parallel. One of the permanent magnets may be made of a material that has a higher coercivity or resistance to having its magnetization direction reversed (e.g., a Neodymium magnet). The second permanent magnet may be made of a material that has a lower coercivity or resistance to having its magnetization direction reversed, and therefore can have its polarization direction changed easily (e.g., an aluminum nickel cobalt (AlNiCo) magnet). The size and material of the two permanent magnets may be selected so that they have essentially the same magnetic strength, i.e., remnant magnetization.

In one embodiment, a coil of wire is wrapped around the lower coercivity magnet, i.e., the second permanent magnet. In another embodiment, a coil may be wrapped around both magnets, since the higher coercivity magnet is chosen such that it will not be repolarized by the field produced by the coil of wire. In another embodiment, there are an even number of magnets, e.g., two, four, or more, all of the same low coercivity material (such as AlNiCo) and the same dimensions. The coil of wire is wrapped around half of the magnets, such that only half of the magnets have polarization switched by the coil. Making all magnets of the same low coercivity material simplifies the matching of the magnetic strength of the repolarized and unrepolarized magnets. This helps to ensure field cancellation in the polarization or off state, as a failure to completely cancel the fields in the polarization state may result in a failure to decouple from a surface, such as the ballast.

Figure 5A:
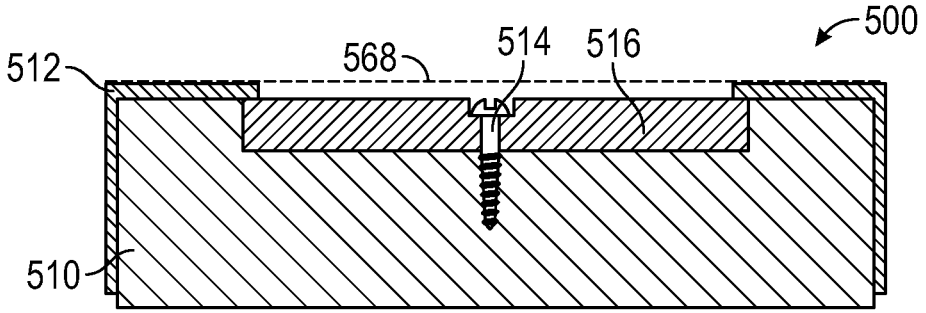
FIG. 5A-5C show cross-sectional views of example ballast weights, in accordance with embodiments of the disclosure.
Figure 5B:
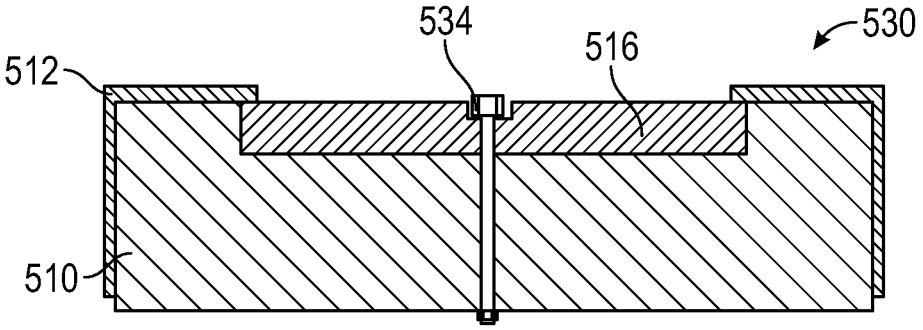

A pulse or pulse sequence applied to the coil of wire in a second direction reverses the polarization of the low coercivity magnet, e.g., the second permanent magnet, in the opposite direction from the high coercivity magnet, e.g., the first permanent magnet. This is described herein as the internal flux or off state, as the magnetic flux travels in a loop through the two permanent magnets, but does not substantially extend outside the switchable magnet (404). This allows the attachment plate (416) to separate from the pole pieces (406) of the switchable magnet (404). Thus, the tool (200) (shown in FIG. 2) may decouple from the attachment plate (416) with the dissolvable ballast (410). FIG. 4A further shows the circuitry (430), and the anode (460) at the dissolvable ballast (410) and the cathode (470). An electrical contact between the dissolvable ballast (410) and the circuitry (430) can be established through the attachment plate (416) and the pole pieces (406) as illustrated in FIG. 4A. To decrease the contact resistance between the attachment plate (416) and the dissolvable ballast (410), a conductive paste or solder may be applied between the two, or a fastener such as screw or bolt and nut may be used to press them against each other as shown in FIGS. 5A and 5B, respectively. To prevent or delay the dissolution process around the electrical contact, these areas may be selectively coated as shown in FIGS. 2, 5A, and 5B.

Referring to FIG. 4B, an alternative ballast release mechanism (450) is shown. The ballast release mechanism (450) relies on a separable wire (R) to hold the dissolvable ballast (410). The separable wire (R) may be burned by applying a current, thereby releasing the dissolvable ballast (410). The dissolvable ballast (410) is electrically connected to the circuitry (430) through the separable wire (R). A segment of the separable wire (R) is also connected to a capacitor (C) through a switch(S). The capacitor (C) may be charged while the switch S is in the S1 position. The switch may be operated to change to the S2 position. This may cause release of the collected charge through the separable wire (R) to melt and separate it. As in the previous case, a coating may be applied around the contact point to delay the dissolution.

Figure 5C:
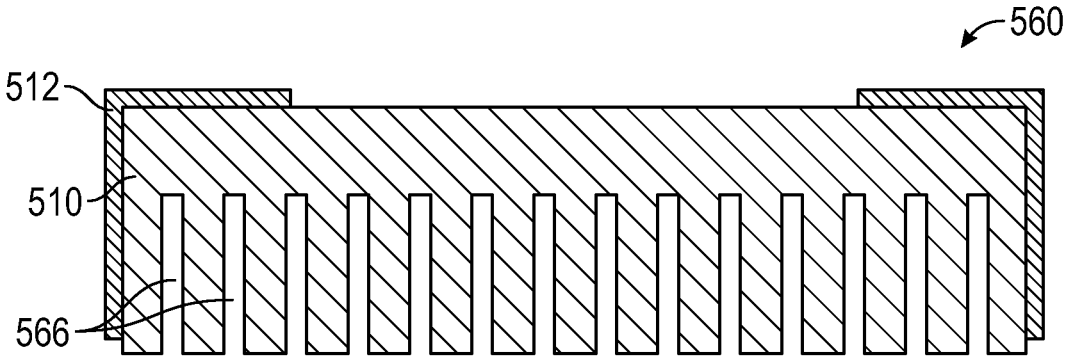

FIGS. 5A-5C show various ballast weights in accordance with embodiments of the disclosure. Each of the ballast weights (500, 530, 560) include a dissolvable ballast (510) and a coating (512), as previously described. Further, the ballast weights (500, 530) include an attachment plate (516), whereas the ballast weight (560) does not have an attachment plate (516). The ballast weight (500) relies on a screw (514) to establish a firm contact between the dissolvable ballast (510) and the attachment plate (516). The ballast weight (530) relies on a bolt (534) to establish a firm contact between the dissolvable ballast (510) and the attachment plate (516). The ballast weight (560) includes cavities (566) or other another form of patterned surface to increase the surface area of the dissolvable ballast, thereby increasing the possible current output of the sacrificial battery. The patterning may include an increased surface roughness, an array of holes, etc.

In some embodiments, the placement of the cathode and anode with respect to each other is optimized to minimize an internal resistance of the sacrificial battery and further to reduce energy losses. This may be accomplished by placing anode and cathode as close as possible while avoiding direct contact. A permeable insulating membrane (568) may be placed over the cathode to prevent unintentional electrical shorts to the anode while decreasing the distance between the two.

Figure 6:
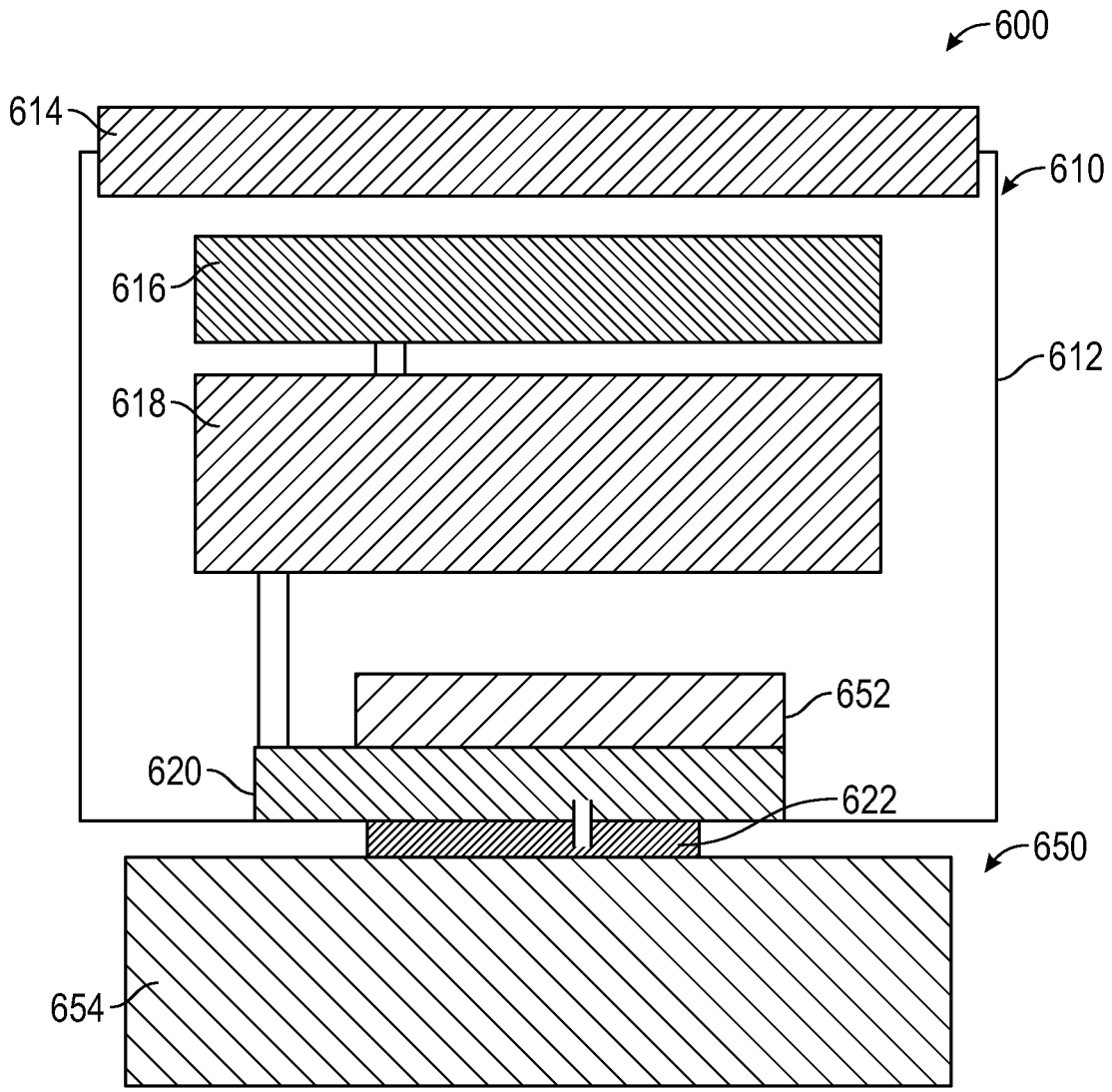
FIG. 6 shows a cross-sectional view of an example untethered device, in accordance with embodiments of the disclosure.

FIG. 6 shows a cross-sectional view of an example untethered device (600), in accordance with embodiments of the disclosure. Various components of the untethered device (600) may be similar to the corresponding components of the untethered device as previously described in reference to FIG. 2. For example, the untethered device (600) includes a tool (610) and a ballast weight (650). The tool includes a housing (612) that is sealed by a lid (614). The housing (612) accommodates various internal components of the tool (610), such as a primary power source (616), primary circuitry (618). The primary power source (616) may be any type of internal power source as previously described, and the primary circuitry (618) may be analogous to the circuitry of the untethered device shown in FIG. 2. However, in one or more embodiments, a ballast release circuit (620) is separate from the primary circuitry (618). The ballast release circuit (620) may operate a ballast release actuator (622) to release the ballast weight (650). The ballast release actuator (622) may operate as previously described. Both the ballast release circuit (620) and the ballast release actuator (622) may be potted, e.g., in a resin, to provide protection in case of a leak.

In one or more embodiments, the components inside the housing (612) are protected from the fluids surrounding the untethered device (600) by the housing (612), sealed by the lid (614). The sealed housing (612) may maintain an atmospheric pressure inside the housing. If a seal fails, the housing may get flooded due to the pressure differential between the two sides of the seal. While this may potentially cause an electrical short of the primary power source (616) and or the primary circuitry (618), the subsequently described fail-safe system may enable recovery of the tool (610).

In one or more embodiments, the ballast release circuit (620) and the ballast release actuator (622) remain operable in case of flooding, e.g., because of the potting providing an additional electrical insulation. In case of a flooding event, a cathode (652) inside the housing (612) gets exposed to the fluid entering the housing. The cathode may be formed from, for example, a metal foil (e.g., copper). A sacrificial battery may be formed by the cathode (652) and the anode (654) and may be activated by the fluid entering the housing (612). The sacrificial battery may power the ballast release circuit (620), which may cause activation of the ballast release actuator (622). As previously described in reference to other embodiments, certain elements may be electrically insulating, whereas other elements are electrically conductive to enable powering of the ballast release circuit (620) by the sacrificial battery.

While FIGS. 2, 3, 4A, 4B, 5A-5C, and 6 show various configurations of components, other configurations may be used without departing from the scope of the disclosure. For example, various components in FIGS. 2, 3, 4A, 4B, 5A-5C, and 6 may be combined to create a single component. As another example, the functionality performed by a single component may be performed by two or more components.

Figure 7:
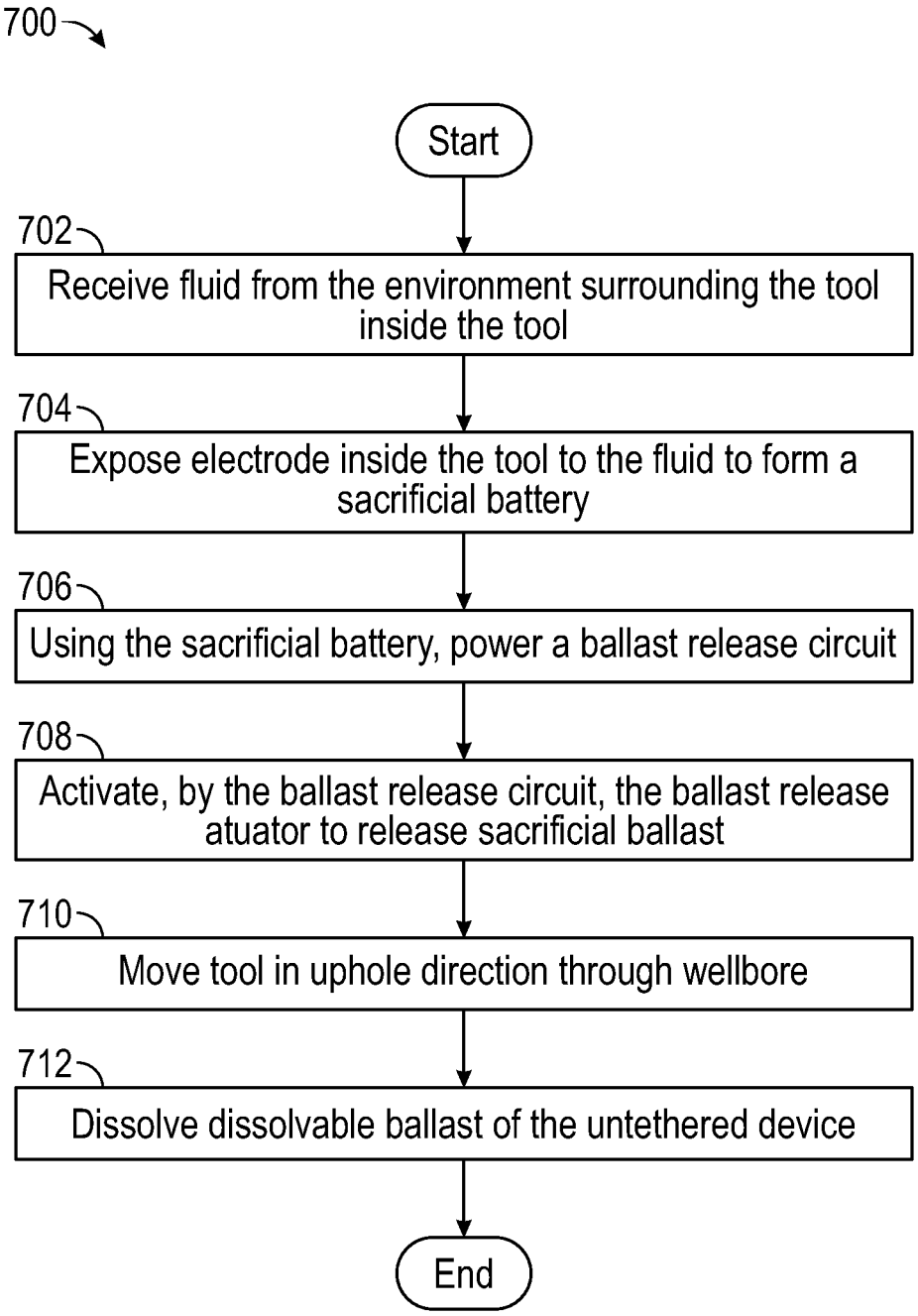
FIG. 7 shows a flowchart of a method in accordance with embodiments of the disclosure.

FIG. 7 shows a flowchart for a method (700) in accordance with embodiments of the disclosure. The method (700) may be used for recovering an untethered device. The untethered device may be as described in reference to FIG. 6, where a sacrificial battery can be used as a fail-safe energy source when the internal energy source is rendered not useful as a result of water flooding into the housing. While the various steps in FIG. 7 are presented and described sequentially, one of ordinary skill in the art will appreciate that some or all of the steps may be executed in different orders, may be combined or omitted, and some or all of the steps may be executed in parallel. Furthermore, the steps may be performed actively or passively. Prior to the execution of the method, the untethered device may have been dropped in a downhole direction through the wellbore. Alternatively, the untethered device may have been dropped in any other fluid environment, e.g., an ocean.

In Step 702, fluid from the environment surrounding the untethered device may be received inside the tool of the untethered device. The fluid may be brine that may enter because of a leak in the housing of the tool.

In Step 704, an electrode inside the housing is exposed to the fluid, thereby forming a sacrificial battery between the electrode inside the housing and an electrode on the ballast weight of the untethered device, with the fluid providing the electrolytic solution of the sacrificial battery.

In Step 706, the sacrificial battery powers a ballast release circuit.

In Step 708, the ballast release circuit actives a ballast release actuator to release the ballast weight, including a dissolvable ballast, of the untethered device.

In Step 710, the tool moves (e.g., rises) in an upward direction, e.g., in an uphole direction through the wellbore.

In Step 712, the dissolvable ballast of the released ballast weight is dissolved.

The tool may measure one or more properties within the well bore while Steps 702-712 are performed.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. An untethered device comprising:

a tool comprising circuitry;

a ballast weight mechanically attached to the tool, and comprising a dissolvable ballast; and a sacrificial battery comprising a first electrode provided by the dissolvable ballast and an electrolytic solution provided by a fluid surrounding the untethered device, wherein the sacrificial battery powers the circuitry.

2. The untethered device of claim 1, wherein the electrolytic solution comprises at least one of sodium chloride and potassium chloride.

3. The untethered device of claim 1, wherein the dissolvable ballast comprises aluminum.

4. The untethered device of claim 3, wherein a second electrode of the sacrificial battery comprises copper, causing the first electrode to operate as an anode and the second electrode to operate as a cathode of the sacrificial battery.

5. The untethered device of claim 1, wherein the sacrificial battery further comprises a permeable insulating membrane disposed over the first electrode to prevent unintentional electrical shorts to a second electrode of the sacrificial battery, adjacent to the first electrode.

6. The untethered device of claim 1, wherein the tool further comprises a housing, and wherein at least part of the housing forms a second electrode of the sacrificial battery.

7. The untethered device of claim 1, wherein dissolvable ballast has a patterned surface to increase a surface area of the first electrode.

8. The untethered device of claim 1, wherein the ballast weight further comprises attachment elements providing a mechanical interface between the tool and the dissolvable ballast.

9. The untethered device of claim 1, wherein the circuitry comprises an internal energy storage configured to power components of the circuitry.

10. The untethered device of claim 9, wherein internal energy storage is one selected from a group consisting of a primary battery, a rechargeable battery, a capacitor, and a super-capacitor.

11. The untethered device of claim 9, wherein the sacrificial battery is configured to charge the internal energy storage.

12. The untethered device of claim 1, wherein the circuitry comprises a step-up converter that increases a voltage of the sacrificial battery.

13. The untethered device of claim 1, wherein the tool further comprises a ballast release mechanism for switchably releasing the ballast weight from the tool.

14. The untethered device of claim 13, wherein the ballast release mechanism comprises one of a switchable magnet and a separable wire.

15. The untethered device of claim 14, further comprising a ballast release circuit separate from other components of the circuitry, wherein the ballast release circuit is configured to remain operable in case of the fluid leaking into the tool.

16. The untethered device of claim 15, further comprising a second electrode of the sacrificial battery, wherein the sacrificial battery is formed by the fluid leaking into the tool and reaching the second electrode.

17. The untethered device of claim 15, wherein the sacrificial battery powers the ballast release circuit.

18. The untethered device of claim 1, further comprising at least one sensor for measuring one or more properties along a wellbore.

19. A method for recovering an untethered device, the method comprising:

receiving, inside a tool of the untethered device, fluid leaking into the tool;

exposing an electrode inside the tool to the fluid to form a sacrificial battery comprising the electrode inside the tool, an electrode on a ballast weight of the untethered device, and the fluid;

powering a ballast release circuit by the sacrificial battery; and activating, by the ballast release circuit, a ballast release actuator to release the ballast weight.

20. The method of claim 19, further comprising dissolving a dissolvable ballast of the ballast weight.

* * * * *